US006554389B1

(12) United States Patent
Hawkins et al.

(10) Patent No.: US 6,554,389 B1
(45) Date of Patent: Apr. 29, 2003

(54) INKJET DROP SELECTION A NON-UNIFORM AIRSTREAM

(75) Inventors: Gilbert A. Hawkins, Mendon, NY (US); Christopher N. Delametter, Rochester, NY (US); David L. Jeanmaire, Brockport, NY (US); James M. Chwalek, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/023,248

(22) Filed: Dec. 17, 2001

(51) Int. Cl.[7] ..... B41J 29/393
(52) U.S. Cl. ..... 347/19
(58) Field of Search ..... 347/73, 74, 75, 347/19, 82, 47, 76, 14, 23, 83, 15, 43, 40, 54, 55, 60, 66, 67, 56

(56) References Cited

U.S. PATENT DOCUMENTS

| | | | | |
|---|---|---|---|---|
| 3,877,036 A | | 4/1975 | Loeffler et al. | 347/77 |
| 4,238,804 A | | 12/1980 | Warren | 347/81 |
| 4,914,522 A | | 4/1990 | Duffield et al. | 358/296 |
| 5,250,962 A | | 10/1993 | Fisher et al. | 347/32 |
| 5,592,202 A | | 1/1997 | Erickson | 347/37 |
| 5,815,178 A | | 9/1998 | Silverbrook | 347/55 |
| 6,036,300 A | * | 3/2000 | Suzuki et al. | 347/41 |
| 6,079,821 A | | 6/2000 | Chwalek et al. | 347/47 |
| 6,213,595 B1 | | 4/2001 | Anagnostopoulos et al. | 347/82 |
| 6,217,156 B1 | | 4/2001 | Hawkins et al. | 347/56 |
| 6,217,163 B1 | | 4/2001 | Anagnostopoulos et al. | 347/75 |
| 6,254,225 B1 | | 7/2001 | Chwalek et al. | 347/82 |

OTHER PUBLICATIONS

U.S. patent application Ser. No. 09/750,946, Jeanmaire et al., filed Dec. 28, 2000.

U.S. patent application Ser. No. 09/751,232, Jeanmarie et al., filed Dec. 28, 2000.

U.S. patent application Ser. No. 09/751,483, Sharma et al., filed Dec. 28, 2000.

U.S. patent application Ser. No. 09/751,563, Chwalek et al., filed Dec. 28, 2000.

U.S. patent application Ser. No. 09/777,426, Hawkins et al., filed Feb. 6, 2001.

* cited by examiner

*Primary Examiner*—Lamson Nguyen
*Assistant Examiner*—Charles W. Stewart, Jr.
(74) *Attorney, Agent, or Firm*—Stephen H. Shaw

(57) ABSTRACT

An apparatus for controlling errant ink drops in an inkjet printer having a plurality of nozzles for ejecting ink drops along a droplet trajectory and printing the ejected ink drops onto a receiver, including: at least one airflow channel arranged to provide a non-uniform airflow pattern located along a portion of the droplet trajectory, wherein the apparatus is in close proximity to the plurality of nozzles and prior to the receiver, such that the non-uniform airflow pattern provides compensation for errors in the printing of the ejected ink drops on the receiver and means for moving air in the airflow channel.

17 Claims, 11 Drawing Sheets

INKJET DROP SELECTION A NON-UNIFORM AIRSTREAM

CROSS-REFERENCE TO RELATED APPLICATIONS

The present application is related to U.S. patent application Ser. No. 09/586,099, filed Jun. 2, 2000, by Hawkins, et al., and entitled, "Permanent Alteration Of A Printhead For Correction Of Mis-Direction Of Emitted Ink Drops;" U.S. patent application Ser. No. 09/696,536, filed Oct. 25, 2000, by Hawkins, et al., and entitled, "Active Compensation For Changes In The Direction Of Drop Ejection In An Inkjet Printhead;" U.S. patent application Ser. No. 09/696,541, filed Oct. 25, 2000, by Hawkins, et al., and entitled, "Active Compensation For Misdirection Of Drops In An Inkjet Printhead Using Electrodeposition;" U.S. patent application Ser. No. 09/750,946, filed Dec. 28, 2000, by Jeanmaire, et al., and entitled, "Printhead Having Gas Flow Ink Droplet Separation And Method Of Diverging Ink Droplets;" U.S. patent application Ser. No. 09/751,483, filed Dec. 28, 2000, by Sharma, et al., and entitled, "Ink Drop Deflection Amplifier Mechanism And Method Of Increasing Ink Drop Divergence;" U.S. patent application Ser. No. 09/751,232, filed Dec. 28, 2000, by Jeanmaire, et al., and entitled, "Continuous Inkjet Printing Method And Apparatus;" and U.S. patent application Ser. No. 09/804,758, filed Mar. 13, 2001, by Hawkins, et al., and entitled, "Continuous Inkjet Printing Method And Apparatus For Correcting Ink Drop Placement."

FIELD OF THE INVENTION

This invention relates to the field of inkjet printing, more particularly to the correction of image artifacts produced by errors in the placement of ink drops printed on a receiver and to methods of guiding ink drops to receivers to produce prints of high image quality.

BACKGROUND OF THE INVENTION

As is well known in the art of inkjet printing, the quality of printed images suffers from the misplacement of a portion of the printed ink drops from their desired print location. Such a misplacement of ink drops may repeatedly occur for all drops ejected by a particular nozzle, because the drops are ejected at an angle different from the desired angle of ejection (i.e., misdirection), for example, as a result of a fabrication defect in the respective nozzle. Alternatively, misdirection may randomly occur from time to time for drops ejected from one or more nozzles, due to physical changes in the nozzle or the environment of the nozzles; for example, changes caused by prolonged heating of a particular nozzle from extended use of that nozzle, or from passage of certain particulates through the nozzle. Also, difficult-to-control interactions between the ink, impurities in the ink, and the nozzle surfaces constitute a random variation that is well known in the art. The forces of nozzle surface tension can cause random misdirection of ejected drops. Random variations in the angle of drop ejection may also occur due to uncontrolled air currents in the vicinity of the nozzles.

Repetitive or consistent variations in the angle of drop ejection of a particular nozzle may be controlled by measuring the degree of variation and correcting for it, using one or more means of correction for drop placement, as disclosed, for example, in co-pending U.S. patent application Ser. No. 09/586,099, filed Jun. 2, 2000, by Hawkins et al., and entitled, "Permanent Alteration Of A Printhead For Correction Of Mis-Direction Of Emitted Ink Drops," which discloses methods for permanently altering the geometry of nozzles, and references therein. However, random variations are more difficult to control, because the angle of drop ejection changes over the life of the printhead and the aforementioned correction means cannot be applied. Such print compensation, while possible, requires a costly measurement apparatus to determine whether all ink drops pass through all predetermined orifices and at least some drops are not printed in their desired print locations, since misdirected drops must be observed in order to have their direction of ejection corrected.

Another strategy for correcting slowly changing variations in the direction of drop ejection is disclosed in U.S. Pat. No. 4,238,804, by Warren, Dec. 9, 1980, assigned to Xerox Corporation, and U.S. Pat. No. 3,877,036, by Loeffler et al., Apr. 8, 1975, assigned to IBM, which teach measuring the position of ejected ink drops and compensating for variations from the ideal direction by electrostatic means. While such electrostatic deflection can be used to direct ink in a desired direction, as is well known in the art, electrostatic deflection in these cases adds mechanical complexity. Also, correction techniques of this type are largely ineffective in cases where large variations in the direction of ejected ink drops occur.

U.S. Pat. No. 5,592,202, by Erickson, Jan. 7, 1997, assigned to Laser Master Corporation, teaches an electronic means to correct inaccuracies in ink drop placement by advancing or retarding the time of a drop-on-demand actuation pulse. However, this method does not correct variations in both of the directions of ink drop ejection in a plane perpendicular to the direction of drop ejection, as it is more suited to adjusting ink drop placement only in the scan direction of the printhead. Moreover, not all printhead circuits can be easily adapted to control the firing times of individual ink drops, since the firing pulses may be derived from a common clock. Also, at least some drops are printed in locations other than their desired print locations, since drop misplacement must be observed in order to be corrected.

U.S. Pat. No. 5,250,962, by Fisher et al., Oct. 5, 1993, assigned to Xerox Corporation, teaches the removal of entrained air in one or more nozzles to correct for drop misdirection without the necessity of measuring the degree of misdirection. However, although entrained air is known in the art to cause variations in the direction of ink drop ejection, it is only one of many mechanisms causing variations.

U.S. Pat. No. 4,914,522, by Duffield, et al., Apr. 3, 1990, assigned to Vutek Inc., discloses a drop-on-demand ink jet printer that utilizes air pressure to produce a desired color density in a printed image. Ink in a reservoir travels through a conduit and forms a meniscus at an end of an inkjet nozzle. An air nozzle, positioned so that a stream of air flows across the meniscus at the end of the ink nozzle, causes the ink to be extracted from the nozzle and atomized into a fine spray which lands on a receiver. The stream of air is applied at a constant pressure through a conduit to a control valve opened and closed by a piezoelectric actuator. When a voltage is applied to the valve, the valve opens to permit air to flow through the air nozzle. When the voltage is removed, the valve closes and no air flows through the air nozzle. While the desired density of the ink on the receiver can be varied on average within a printed pixel region by varying the pulse width of the airstream, the drops so produced arise from many places on the meniscus, are of many sizes, are ejected at many different angles, and land in a variety of places on the receiver, even when only a single pixel is printed, due to the turbulence of the airstream and its role in pulling drops off the meniscus, as can be appreciated by one skilled in the art of air-meniscus interactions. No two single pixels would be printed identically when the precise position of the drops is considered. Additionally, the airstream must be turned on and off repeatedly so that a steady, equilibrium airflow is never attained.

Other techniques for achieving compensation include the selection of one nozzle among a plurality of redundant nozzles for printing a particular imaging pixel, the preferred nozzle having favorable ink drop ejection characteristics. However, redundancy selection techniques of this type are complex in nature and require substantial real estate space on the printhead. Such methods also increase cost and/or reduce productivity, and again, at least some drops may not printed in their desired print locations, since a failed nozzle must be observed in order to be replaced by a redundant nozzle.

U.S. Pat. No. 5,815,178, by Silverbrook, Sep. 29, 1998, describes a means for partially correcting drop placement errors that does not require observing or printing misdirected drops and thus is cabable of correcting truly random variations in the direction of drop ejection. According to this method, the use of high electric fields to pull the drops toward a direction of field lines perpendicular to the plane of the nozzle's surfaces, thereby helping guide all drops ejected from all nozzles toward their respective desired print locations. Since all drops are guided toward their respective desired print locations, whether they are misdirected or not, the electric field automatically corrects drop placement errors resulting form all types of drop misdirection, random or constant. However, the electric field of Silverbrook, to effectively accomplish its purpose, must be very large and consequently produces undesired electrical arcing.

Thus, it is desirable to provide a device and method of operation of an inkjet printhead that provides correction for ink drop placement errors, including random misdirection of the angles at which ink drops are ejected, accordingly being advantageous to print quality without penalty of print productivity and cost and which is capable of repeatedly and predictably placing drops in exact locations desired for printing without perturbing the drop ejection process.

SUMMARY OF THE INVENTION

The present invention provides a device and a method of operation of an inkjet printhead, that corrects for drop placement errors, including random misdirection of the angles at which drops are ejected. Such a method is advantageously accomplished without the need to measure the direction of ejection of drops.

One feature of the present invention is that the trajectories of drops that are initially ejected in a direction other than that of a desired direction are continuously corrected over a substantial portion of their time of flight from the nozzle to the receiver.

Another advantageous feature of the present invention is that the device and method do not require energy consuming means to redirect misplaced drops.

It is yet another advantage of the present invention that the device and method may be applied advantageously to a variety of types of drop ejectors, including continuous and drop-on-demand ejectors.

Still another advantage of the present invention is that the distance from the nozzle to the receiver may be made larger than would otherwise be possible.

It is a further advantage of the present invention that the cost of the present invention does not substantially increase with the number of printhead nozzles.

The present invention is directed to overcoming one or more of the problems set forth above by providing an apparatus for controlling errant ink drops in an inkjet printer having a plurality of nozzles for ejecting ink drops along a droplet trajectory and printing the ejected ink drops onto a receiver, including: a) at least one airflow channel arranged to provide a non-uniform airflow pattern located along a portion of the droplet trajectory, wherein the apparatus is in close proximity to the plurality of nozzles and prior to the receiver, such that the non-uniform airflow pattern provides compensation for errors in the printing of the ejected ink drops on the receiver, and b) means for moving air in the airflow channel; and by providing a method of printing ink drops onto a receiver to desired printing locations, comprising the steps of: a) providing an airflow guide channel to guide the printed ink drops, b) ejecting ink drops from a printer nozzle, c) directing a non-uniform airstream through the airflow channel to cause errant ink drops to automatically correct before placement on the receiver regardless of any initial misdirection of the ink drops, and d) printing corrected ink drops onto the receiver.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

To facilitate understanding, identical reference numerals have been used, where possible, to designate identical elements that are common to the figures.

DETAILED DESCRIPTION OF THE INVENTION

The objectives of the present invention are accomplished in a printhead having a closely juxtaposed droplet trajectory guide over the ejection nozzles; the droplet trajectory guide provide a non-uniform flow of air configured to alter the angle of drops ejected from a given nozzle so that all such drops are displaced toward a desired printing location on the receiver, regardless of the angle, size, and velocity of the ejected drop.

The closely juxtaposed, droplet trajectory guide preferably comprises an array of airflow channels through which air is forced to flow in patterns conducive to altering the trajectory of all ejected drops; the resulting trajectory alteration causes drops to land, principally in desired positions regardless of the ejected angles of the drops and without the need to measure drop for possible misdirection.

The airflow channels are preferably defined by solid surfaces through which air is forced by means of applying pressure to selected portions of the airflow channels. Alternatively, the airflow channels include moving solid surfaces to establish airflow patterns with high airflow velocities near the solid surfaces.

One strategy effective in controlling random drop misdirection is disclosed in co-pending U.S. patent application Ser. Nos. 09/696,536 and 09/696,541 by Hawkins et al., which describe means of changing the direction of ejected drops form time to time in response to observations of misdirected drops.

Co-pending U.S. patent application Ser. Nos. 09/750,946 (Jeanmaire, et al.), 09/751,232 (Jeanmaire, et al.), and 09/09/751,483 (Sharma, et al.) disclose the use of a stream of air directed so as to separate drops of different sizes and thereby to distinguish between drops that are to be printed and drops that are to be intercepted by a gutter or catcher. Although the airstream is effective in spatially separating printing and non-printing drops, the printing drops may be misdirected and subsequently printed in non-desired locations if their size is not precisely controlled. In the apparatus disclosed in co-pending U.S. patent application Ser. No. 09/751,483 (Sharma, et al.), a drop that is misdirected during ejection results in an exaggerated amount of misplacement of the printed drop on the receiver, compared to the misplacement that would have been caused by a similar misdirection in the absence of the disclosed airstream.

In co-pending U.S. patent application Ser. No. 09/804,758 (Hawkins, et al.), a method is disclosed for correcting drop misdirection in a printer separating large and small drops with a uniform airstream using thermal steering. However, in accordance with this method, at least some drops are printed in locations other than their desired print locations, since drop misplacement must again be observed in order to be corrected.

Figure 1A:
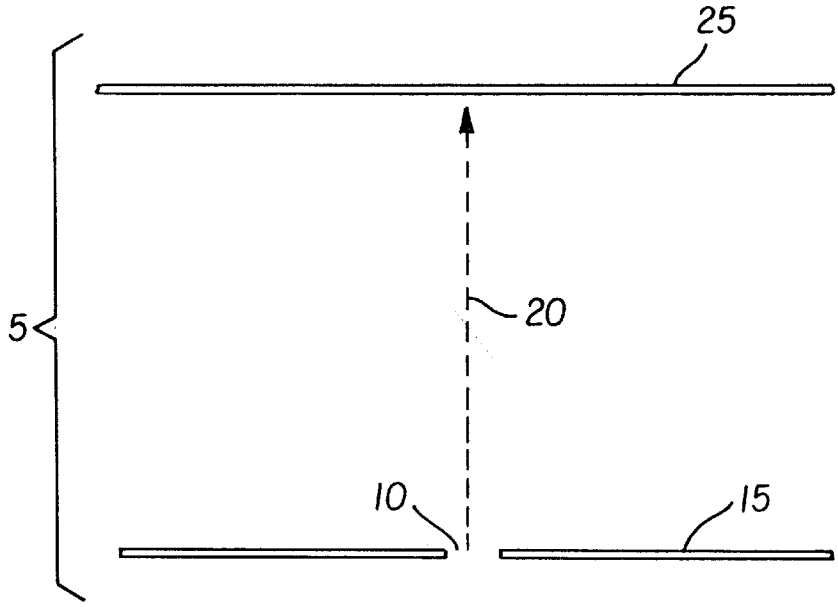
FIG. 1a (Prior Art)
FIG. 1*a* a shows a cross-section of one nozzle of a prior art inkjet printhead ejecting drops to be printed in a desired position on a receiver.

FIG. 1*a* shows a portion of a prior art inkjet printer 5 having a nozzle 10 disposed on a printhead top surface 15 which ejects drops for printing on a receiver 25. The drop trajectory 20 is shown as an ideal trajectory, that is a trajectory which, at least close to the nozzle 10, is perpendicular to the printhead top surface 15. As is well known in the art, the actual trajectory of drops ejected from nozzles may vary, depending on the nozzle geometry, nozzle cleanliness, degrees of air imbibition within the nozzle, ambient air currents, vibrations of the printhead, etc. Variations in drop trajectories from the ideal trajectory most frequently arise from variations in the initial direction of drop ejection at the printhead top surface. The trajectories may consistently vary from nozzle to nozzle, or may vary, for a given nozzle, over time. Thus, variations may be systematic or random. Random variations occur on a time scale comparable to or more rapid than that of the time between the ejection of subsequent drops.

Figure 1B:
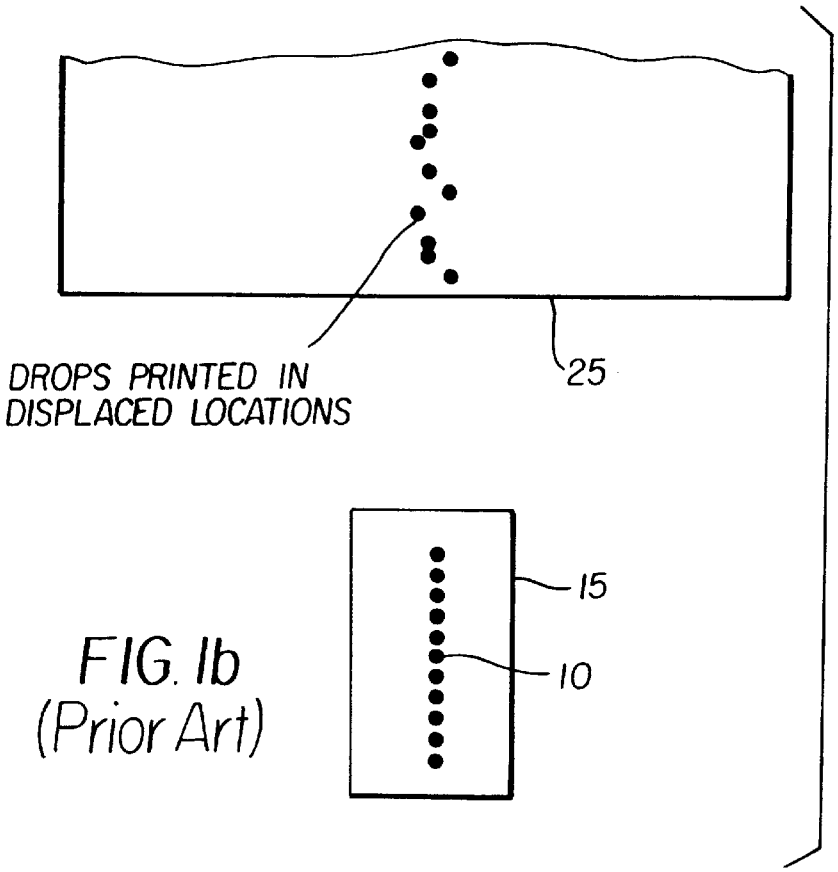
FIG. 1b (Prior Art)
FIG. 1*b* shows a top view of a prior art inkjet printhead (bottom of figure) with a row of nozzles, equally spaced in a straight line, ejecting drops to be printed in desired positions on a receiver, in this case, a straight line of drops equally spaced, here the printed image (top of figure) deviates from a straight line of drops equally spaced due to errors in the direction of drop ejection.

Variations in the actual drop trajectories from the ideal drop trajectory can cause the position of printed drops on the receiver to deviate from desired locations to displaced locations. Drops printed at displaced locations are shown in FIG. 1*b*, which is a top view of FIG. 1*a*. Had the drops in FIG. 1*b* all traveled along ideal trajectories, the printed drops would have formed a pattern of regular spacing in a straight line, assuming the printhead had a planar printhead top surface and nozzles regularly spaced in a straight line. Printing ink drops in displaced locations is well known to produce undesirable printing artifacts.

Figure 1C:
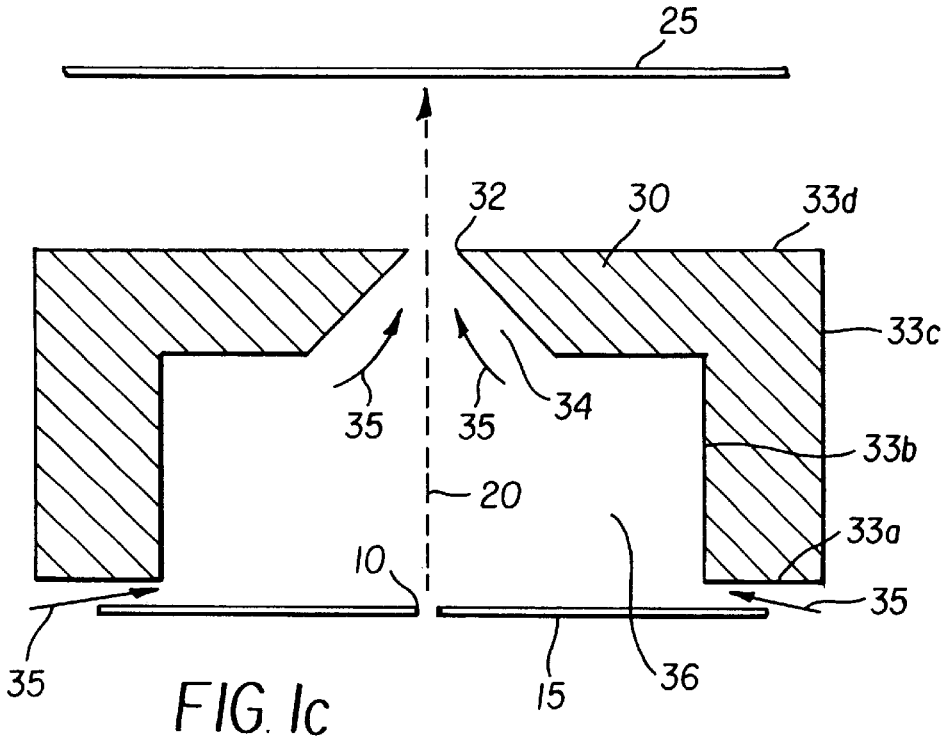
FIG. 1*c* shows an inkjet printhead in accordance with the present invention with a droplet trajectory guiding apparatus.

FIG. 1*c* shows a printhead top surface 15 with a nozzle 10 that ejects drops to be printed on a receiver 25 and having a droplet trajectory-guiding apparatus 30 disposed between the receiver 25 and the printhead top surface 15, the cross-section of which droplet trajectory-guiding apparatus 30 comprises an exit orifice 32 and a taper region 34 surrounded by walls 33, specifically a bottom wall 33*a*, an inner wall 33*b*, an outer wall 33*c*, and a top wall 33*d*. This structure acts to guide air, provided by an air source (not shown) such as air provided by a fan or by tubing connected to compressed air, from a location near the bottom of the droplet trajectory-guiding apparatus 30 out through the airflow exit orifice 32. The air pressure is applied between the print head and the bottom wall 33*a*. Because of the taper region 34, the streamlines of flowing air 35 are non-uniform, that is they vary in their magnitude and spatial direction in at least a portion of the region through which the droplets move and are directed out through the exit orifice 32, thereby influencing the drop trajectories, thus causing drops to move toward the exit orifice's center, as is well known from studies of the motion of particles in flowing fluids. The droplet trajectory-guiding apparatus 30 can be constructed of metal or plastic, and may be separate from the inkjet print head (not shown) or may be an integrated part of the inkjet print head.

Figure 1D:
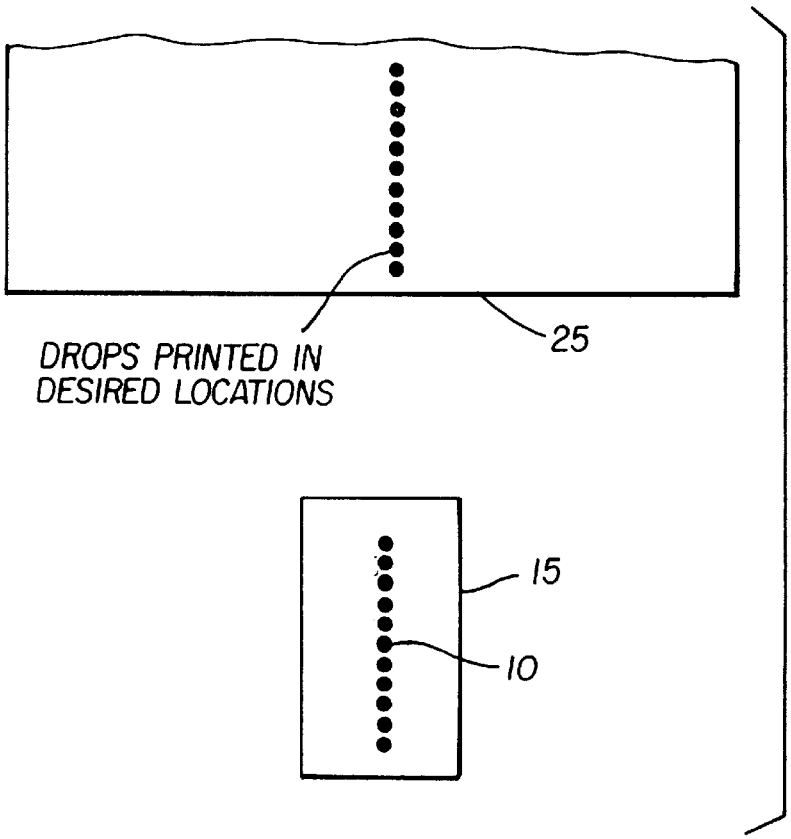
FIG. 1*d* shows a top view (bottom of figure) of the inkjet printhead of FIG. 1*c* with a row of nozzles ejecting drops to be printed in desired positions (i.e., a straight line of drops equally spaced) on a receiver. The printed image (top of figure) is substantially a straight line of drops, equally spaced, despite errors in the direction of drop ejection.

In particular, in cases such as that illustrated in prior art FIGS. 1*a* and 1*b* in which there are either systematic or random variations in the angles of drop ejection, either for a given nozzle 10 or from nozzle-to-nozzle, the action of the flowing air 35 through the droplet trajectory-guiding apparatus 30 causes drops to print, substantially, in desired locations. Drops which would have traveled along trajectories other than the ideal trajectory (i.e., errant drop trajectories) due, for example, to random misdirection during ejection, are now subject to forces from the flowing air 35 in the droplet trajectory-guiding apparatus 30. The flowing air 35 in the droplet trajectory-guiding apparatus 30 causes those errant trajectories to correct, such that the pattern of printed dots more closely resembles the pattern of the nozzles 10 on the printhead top surface 15. According to the present invention, errant drop trajectories are corrected so that the location of the printed drops is substantially independent of the direction of initial drop ejection. Systematic or random variations in drop placement are thus substantially eliminated. In FIG. 1*d*, the desired locations of the printed drops form a pattern closely resembling the pattern of the nozzles 10 on the printhead top surface 15, although this need not always be the case as will be described later.

Figure 1F:
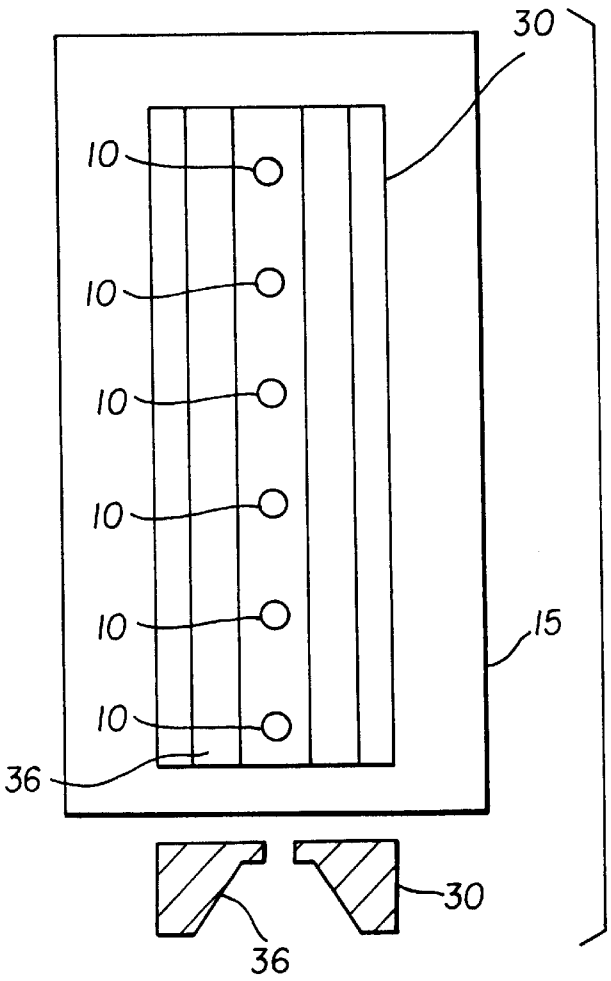
FIG. 1*f* shows a top view of the inkjet printhead (bottom of figure) of FIG. 1*c* illustrating an alternative preferred embodiment of the droplet trajectory guides having no partitions between the nozzles.
Figure 1E:
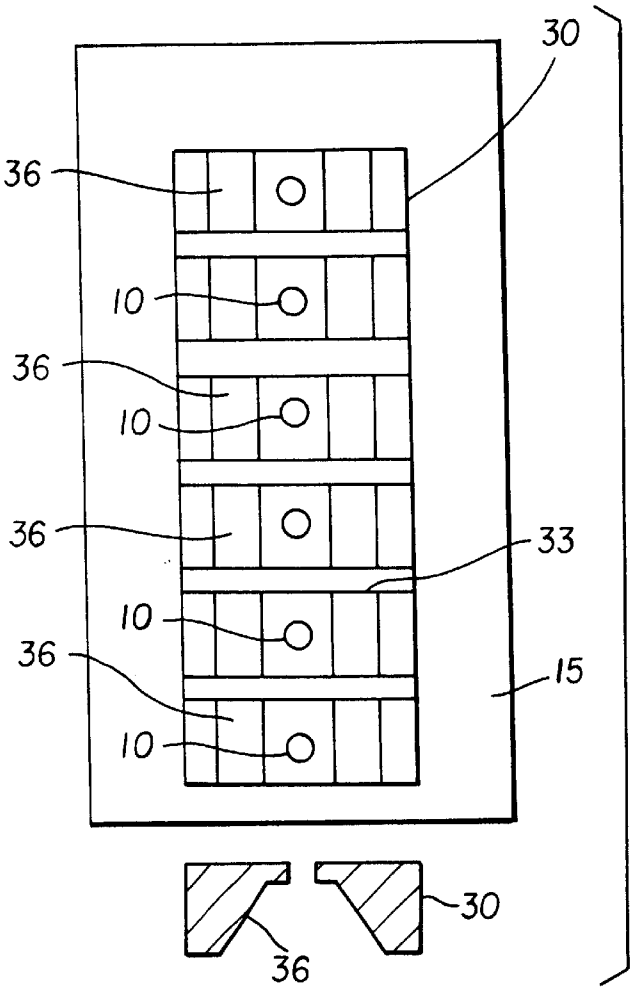
FIG. 1*e* shows a top view of the inkjet printhead of FIG. 1*c* illustrating an embodiment having a droplet trajectory guide with partitions between the airflow channels associated with each of the nozzles. The cross-sectional profile of a portion of the droplet trajectory guide is shown schematically at the bottom of the figure.

FIGS. 1*e* and 1*f* show top views of two embodiments of the droplet trajectory guiding apparatus 30. In FIG. 1*e*, the droplet trajectory-guiding apparatus 30 is composed of a plurality of airflow channels 36, sometimes referred to as air guides or airflow guides, that are in a one-to-one correspondence with each nozzle 10 and has nozzle walls 33 between the nozzles, where as in FIG. 1*f*, the droplet trajectory-guiding apparatus 30 is uniform along the line of nozzles 10. In FIG. 1*f* there are no walls shown between the nozzles 10 so that the droplet trajectory-guiding apparatus 30 has a single airflow channel 35. Other arrangements are also consistent with the intent of the present invention, for example, the droplet trajectory-guiding apparatus 30 may differ from nozzle to nozzle, in which case the pattern of printed drops will differ from the pattern of the nozzles on the printhead top surface 15. (See also, FIG. 8*a* and relevant discussion.)

Figure 2B:
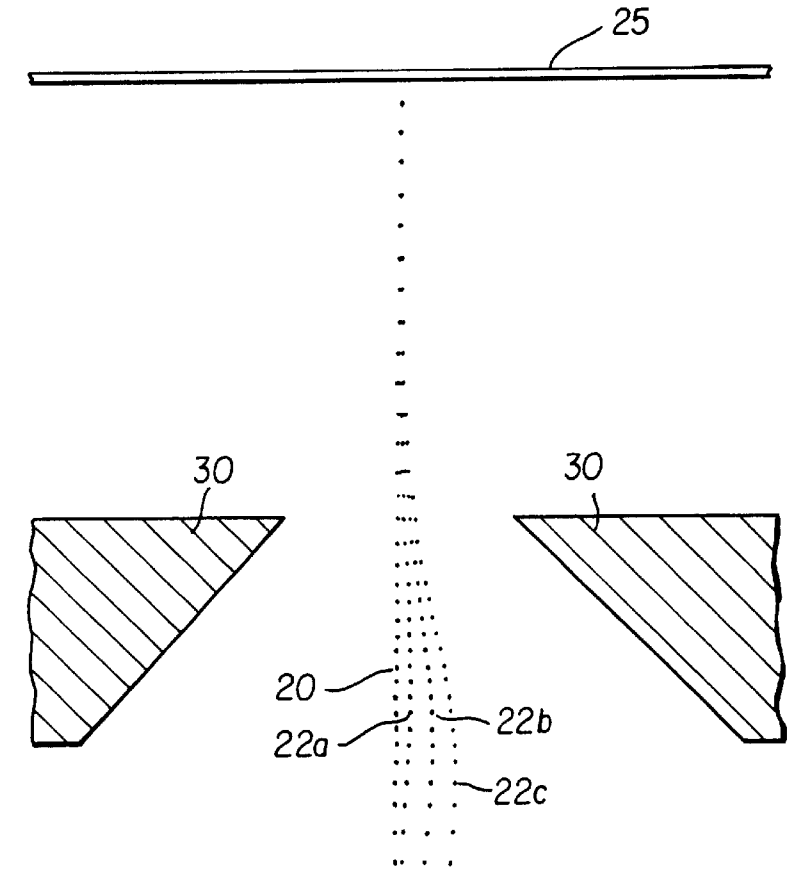
FIG. 2*b* shows a tapered airflow droplet trajectory-guiding apparatus in accordance with the present invention.
Figure 2A:
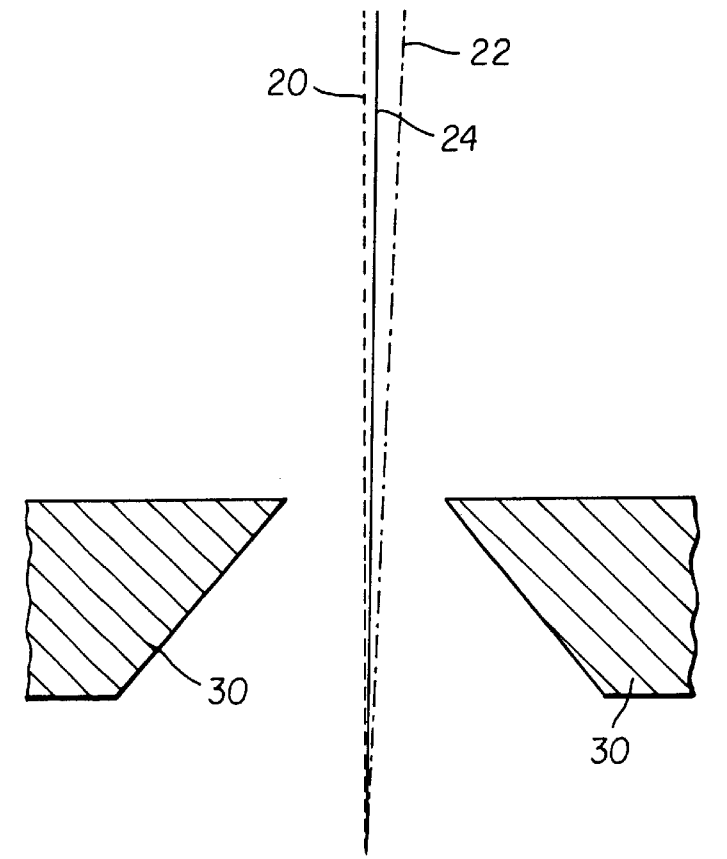
FIG. 2*a* shows a tapered airflow droplet trajectory-guiding apparatus in accordance with the present invention.

In FIG. 2*a*, results from an accurate model of the effect of airflow on drops having different ejection angles (and hence different drop trajectories) are shown quantitatively, for the taper geometry of a first preferred embodiment of a droplet trajectory-guiding apparatus 30. Specifically, FIG. 2*a* shows a tapered airflow droplet trajectory guiding apparatus 30 in cross-section in accordance with the present invention for correcting trajectory errors of drops ejected from a particular nozzle regardless of the direction of drop ejection. Three different drop trajectories of paths are shown in FIG. 2*a*, corresponding to different errors in the initial angle of drop ejection, shown in this case as lying in the plane of FIG. 2*a*. The leftmost path corresponds to no trajectory error (ideal drop trajectory); the rightmost path (errant drop trajectory) to a trajectory error of 2.5 degrees in the initial angle of drop ejection for a case with no airflow in the airflow channel, and the central path to a trajectory error of 2.5 degrees with an airflow in the airflow channel (corrected drop trajectory). As shown in FIG. 2*a*, an errant drop trajectory 22 is caused by air flowing through the guide to more nearly approximate the trajectory of an ideal drop. The errant drop trajectory 22 is thus caused to become a corrected drop trajectory 24. The forces responsible from the correction of the errant drop trajectory 22 are shown in FIG. 2*a* to be due to a gradient in the horizontal (x component) direction of airflow 35 from a high velocity region to a low velocity region, the low velocity region lying symmetrically disposed to the exit orifice 32, as can be appreciated by one skilled in the art of modeling of fluid flows. The more errant drop trajectories 22, i.e. those caused by large initial variations of the ejection angle of drops, follow initial trajectories that take them into regions of high values of horizontal airflow. The horizontal airflow , not shown in FIG. 2*a*, pushes the drops back toward an ideal trajectory 20. Such a corrective push preferably occurs in the first half of the drop trajectory so that the effect of this push continues along as large as possible portion of the drop's subsequent trajectory.

Similarly, in FIG. 2*b*, the correction of a first, second, and third errant drop trajectory 22*a*, 22*b*, 22*c*, respectively, by the droplet trajectory guiding apparatus 30 of the present invention is shown. Specifically, FIG. 2*b* shows a tapered airflow droplet guiding apparatus 30 in cross-section in accordance with the present invention for correcting trajectory errors of drops ejected from a particular nozzle regardless of the direction of drop ejection. Four different drop trajectories or paths are shown. The leftmost path corresponds to no trajectory error; the adjacent path to a first trajectory error with no offset; the rightmost path to a third trajectory error having a 12 micron offset; and the adjacent path to the rightmost path having a 6 micron offset. The errant trajectories 22*a*, 22*b*, and 22*c* arise from angular drop ejection variations that cause maximum deviations of the drop trajectories by 3, 5, and 12 microns, respectively. As is well known in the art, a deviation of as low as 6 microns can result in reduced image quality of printed images. The more errant the drop the longer the duration of exposure of the drops to higher horizontal velocity regions, where the drops are pushed back toward an ideal trajectory 20. The corrective push preferably occurs during the first portions of the drop's trajectory so that the effect of this push continues along as large as possible a portion of the drop's subsequent trajectory.

Figure 3A:
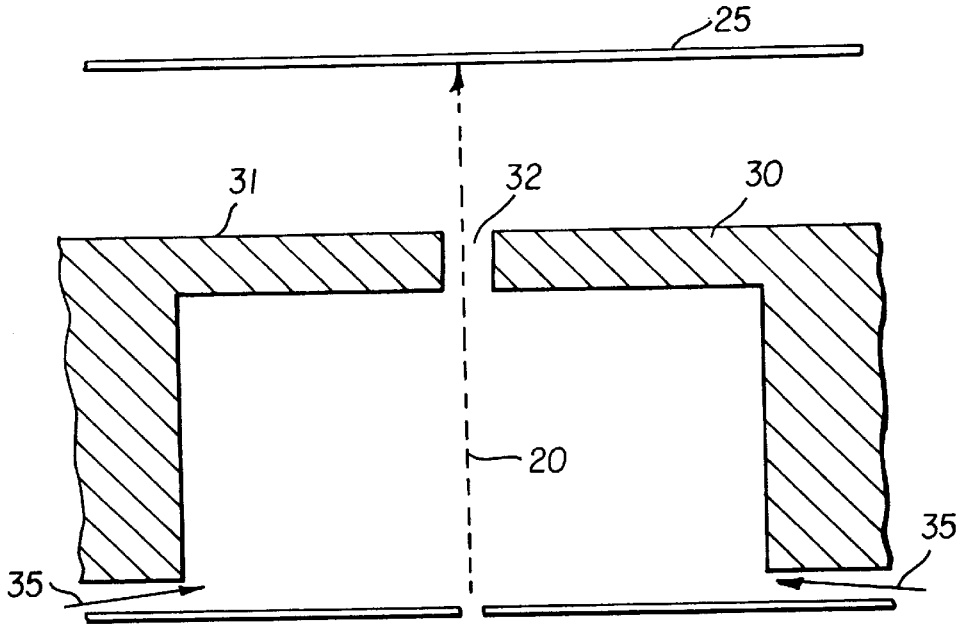
FIG. 3*a* shows a shelf configuration of the droplet trajectory-guiding apparatus in cross-section.
Figure 3B:
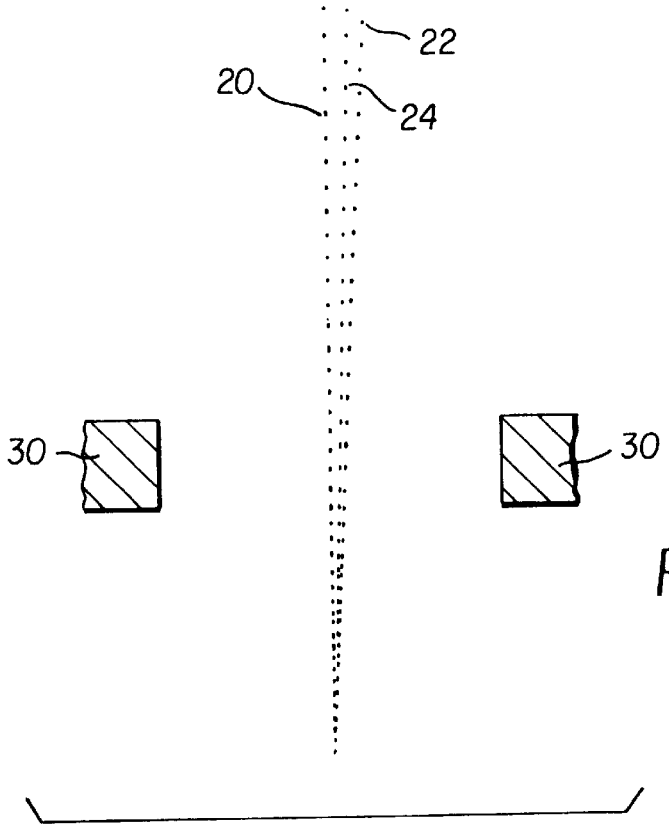
FIG. 3*b* shows airflow in the device of FIG. 3*a*. Three different drop trajectories are illustrated.

FIG. 3*a* shows an alternative embodiment of the droplet trajectory guiding apparatus 30, the apparatus 30 having a shelf region 31 in proximity to the exit orifice 32. In the discussion of FIG. 2*a*, the leftmost path of the three drop trajectories shown corresponds to no trajectory error; the rightmost path to a trajectory error of 2.5 degrees with no airflow, and the central path to a trajectory error of 2.5 degrees with an airflow. FIG. 3*b* shows quantitative corrections of the trajectory of an errant drop trajectory 22 having an angle of ejection of 2.5 degrees from the angle of an ideal drop trajectory 20. Again, the forces responsible from the correction of the errant drop trajectory 22 are shown in FIG. 2*a* to be due to a gradient in the horizontal (x component) direction of airflow 35 from a high velocity region to a low velocity region, the low velocity region lying symmetrically disposed to the exit orifice 32, as can be appreciated by one skilled in the art of modeling of fluid flows.

Figure 4A:
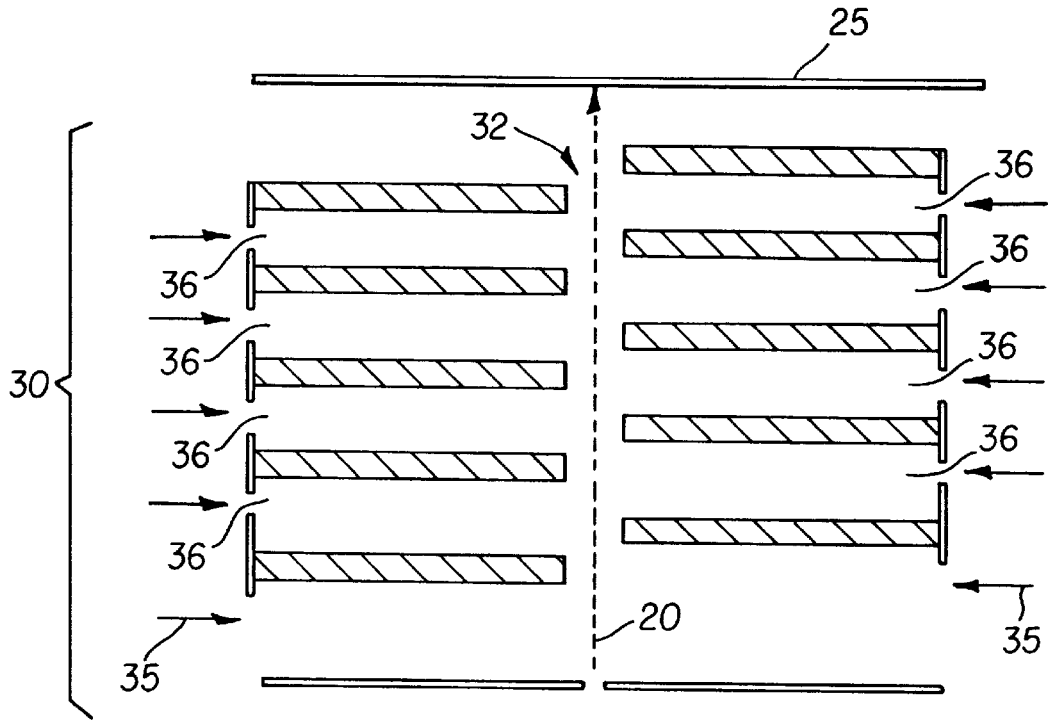
FIG. 4*a* shows a staggered straight wall droplet trajectory guiding apparatuses in cross-section in accordance with the present invention for correcting trajectory errors of drops ejected from a particular nozzle regardless of the direction of drop ejection.
Figure 4B:
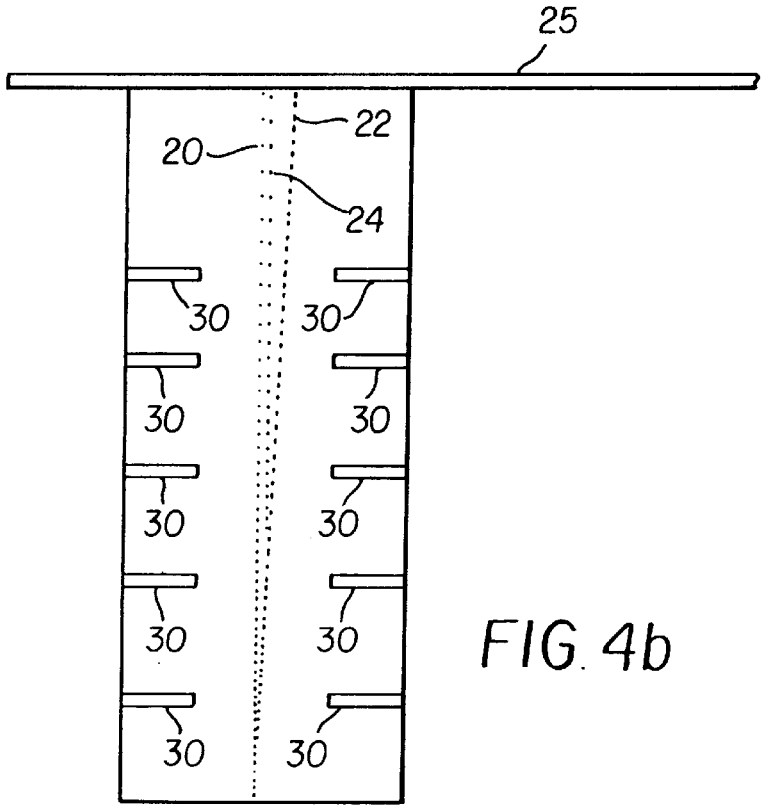
FIG. 4*b* shows a straight wall airflow for the staggered configuration FIG. 4*a*, three different drop trajectories are illustrated.

FIG. 4*a* shows another embodiment of the droplet trajectory guiding apparatus 30 of the current invention, the embodiment having multiple offset airflow channels 36 in proximity to the exit orifice 32. As in the discussion of FIG. 2*a*, FIG. 4*b* shows quantitative corrections of the trajectory of an errant drop having an angle of ejection of 2.5 degrees from the ideal angle. The leftmost path corresponds to no trajectory error, the rightmost path to a trajectory error of 2.5 degrees with no airflow, and the central path to a trajectory error of 2.5 degrees with an airflow. It is clear from FIG. 4*b*, that the drop initially misdirected by an angle of 2.5 degrees and printed on the receiver 25 corresponding to the corrected trajectory 24 would be substantially closer to a printed drop having no initial angular misdirection. The airflow channels 36 of FIG. 4*a* may be equally pressurized to provide airflow 35 in the horizontal directions or each may be pressurized optimally to a different pressure value. Generally, the forces responsible from the correction of the errant drop trajectory arise from airflow 35 perpendicular to the errant trajectory 22. Drops following an ideal trajectory 20, experience no such force or experience a reduced force, as can be appreciated by one skilled in the art of modeling of fluid flows.

Figure 5:
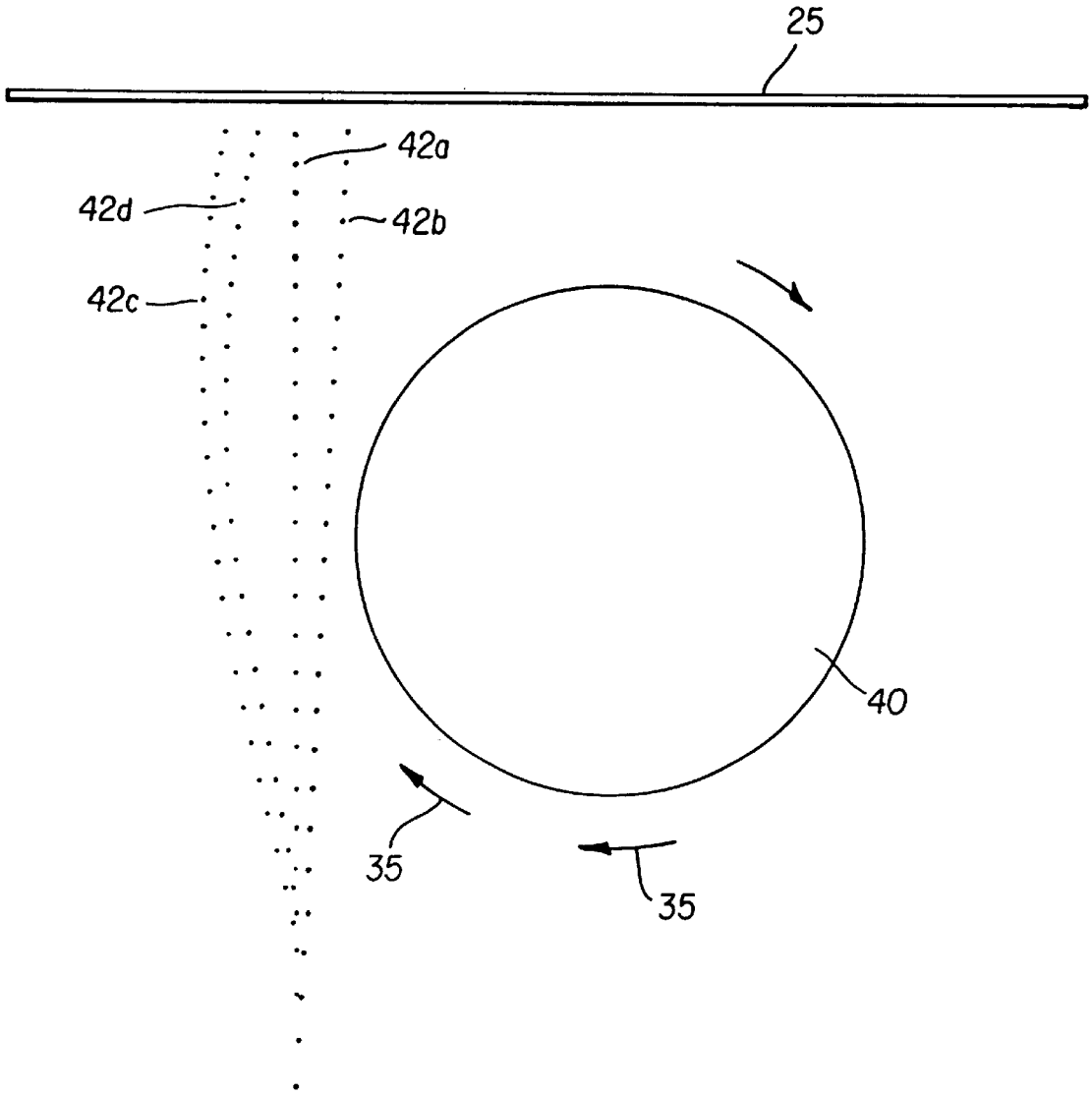
FIG. 5 shows a rotating airflow droplet trajectory-guiding apparatus in cross-section in accordance with the present invention.

FIG. 5 shows yet another embodiment of the droplet trajectory-guiding apparatus 30 of the present invention, the embodiment providing a rotating cylinder 40 whose surface lies adjacent to the trajectories of the drops. Specifically, FIG. 5 shows a rotating airflow droplet trajectory guiding apparatus 30 in cross-section in accordance with the present invention for correcting trajectory errors of drops ejected from a particular nozzle regardless of the direction of drop ejection. Four different drop trajectories or paths are shown. The leftmost path corresponds to no trajectory error, the rightmost path to a trajectory error of 2.5 degrees with no airflow, and the two central paths to a trajectory error of 2.5 degrees with the airflow on, and no trajectory error with the airflow on. The non-uniform airflow 35 induced around the cylinder due to its rotation alters the trajectories of the passing drops in a way such that drops having errant trajectories 22, which would otherwise impinge on the receiver 25 in misplaced locations, are caused to be directed more nearly along ideal trajectories 20 and to impinge more nearly onto the receiver 25 in desired locations. The trajectories labeled 42*a*, 42*b*, 42*c*, and 42*d* in FIG. 5 illustrate schematically how the airflow around the cylinder causes the correction of errant trajectories. Four trajectories 42*a*–42*d* are shown in FIG. 5, including trajectories 42*a* and 42*b* of drops ejected with no rotation of the cylinder. Trajectory 42*a* corresponds to an ideal trajectory 20 while trajectory 42*b* is errant due to a 2.5 degree misdirection to the right in FIG. 5. The separation of the trajectories at along the receiver 25 at the top of FIG. 5 indicates the drop displacement on the receiver for the errant trajectory 22. The trajectories 42*c* and 42*d* correspond to drops ejected when the cylinder is rotating with a surface velocity of 1 m/s. Trajectory 42*c* corresponds to an ideal trajectory while trajectory 4 is errant due to a 2.5 degree misdirection to the right in FIG. 5, similar to the case of trajectories 42*a* and 42*b*. The separation of the trajectories 42*c* and 42*d* along the top of FIG. 5 is smaller than the separation of trajectories 42*a* and 42*b*, showing that the non-uniform airflow caused by the moving surface of the cylinder has resulted in a correction of drop trajectories.

Figure 6:
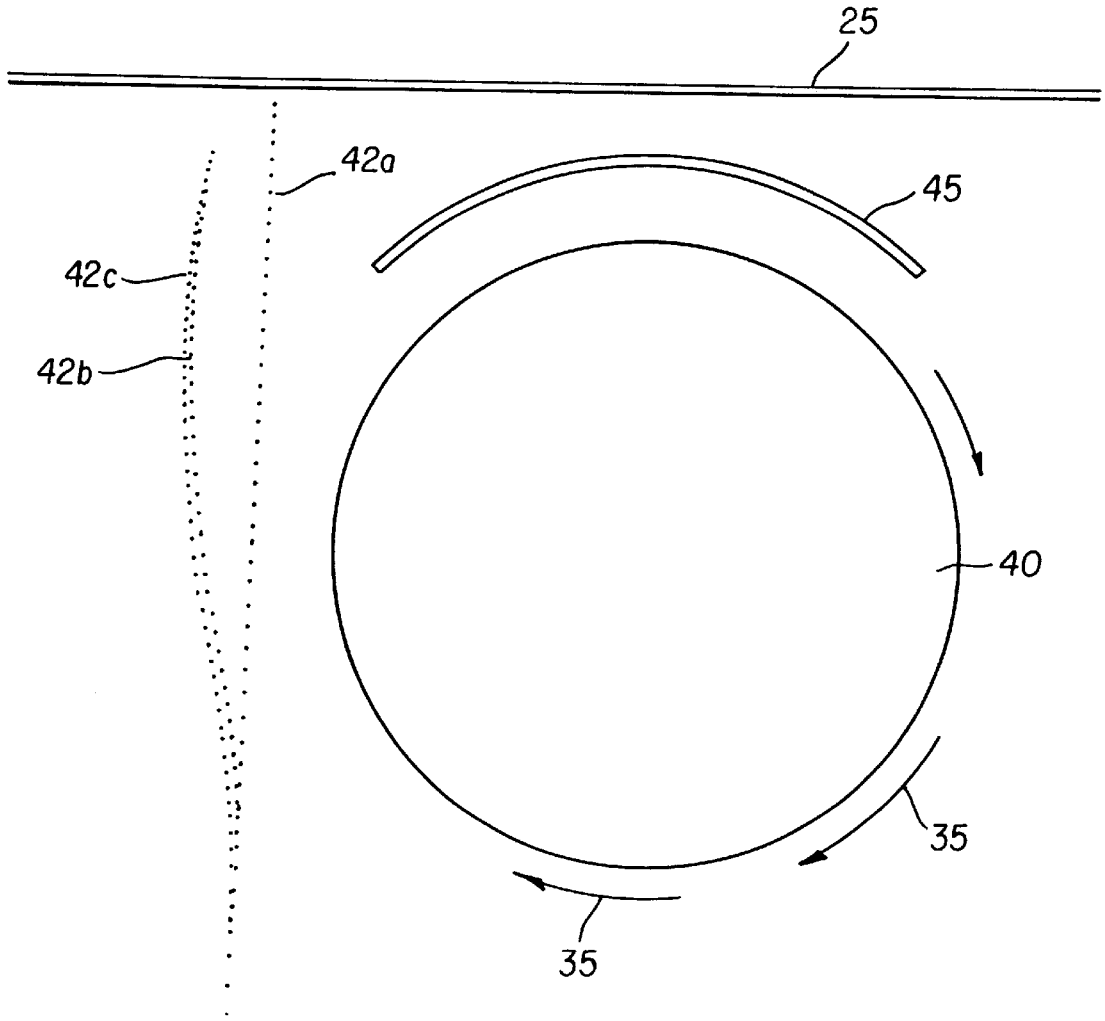
FIG. 6 shows a rotating airflow droplet trajectory-guiding apparatus with an airflow shield in accordance with the present invention for correcting trajectory errors of drops ejected from a particular nozzle regardless of the direction of drop ejection. Three different drop trajectories are illustrated.

FIG. 6 shows yet another embodiment of the droplet trajectory guiding apparatus 30 of the present invention, the embodiment providing a rotating cylinder 40 having an airflow shield 45. Again, the surface of the cylinder lies adjacent to the trajectories of the drops. The airflow shield 45 modifies the airflow 35 induced by the moving surface of the cylinder 40, specifically reducing the rotational airflow along the portion of the trajectories nearest the receiver 25 in comparison with FIG. 5. Airflow in this region is not effective in correcting errant trajectories 22, since the horizontal component of velocity along this.portion of the trajectory is opposite in sign to that in the portion of the trajectory farthest from the receiver 25. As in the case discussed in FIG. 5, the non-uniform airflow 35 induced around the cylinder 40 due to its rotation alters the trajectories of the passing drops in a way such that drops having errant trajectories 22 that cause them to impinge on the receiver 25 in misplaced locations are directed more nearly along ideal trajectories 20 and to impinge more nearly onto the receiver 25 in desired locations. Trajectory 42*a* corresponds to a trajectory in the absence of cylinder rotation. The trajectories 42*b* and 42*c* correspond to drops ejected when the cylinder 40 is rotating with a surface velocity of 1 m/s. Trajectory 42*b* corresponds to an ideal trajectory while trajectory 42*c* is errant due to a 2.5 degree misdirection to the right in FIG. 5, similar to the case of trajectories 42*a* and 42*b*. There is very little separation of the trajectories 42*b* and 42*c* along the top of FIG. 5, showing that the non-uniform airflow caused by the moving surface of the cylinder as modified by the stationary surface of the airflow shield has resulted in a correction of drop trajectories.

Figure 7A:
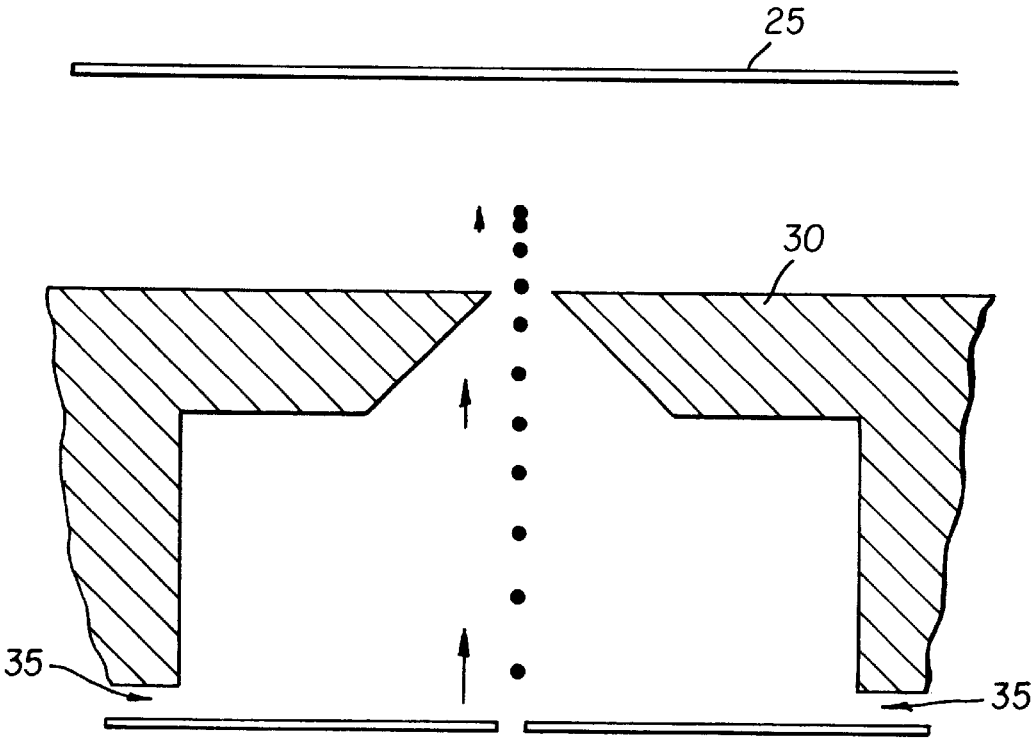
FIG. 7*a* shows a cross-section of the inkjet printhead of FIG. 1*c;*
Figure 7B:
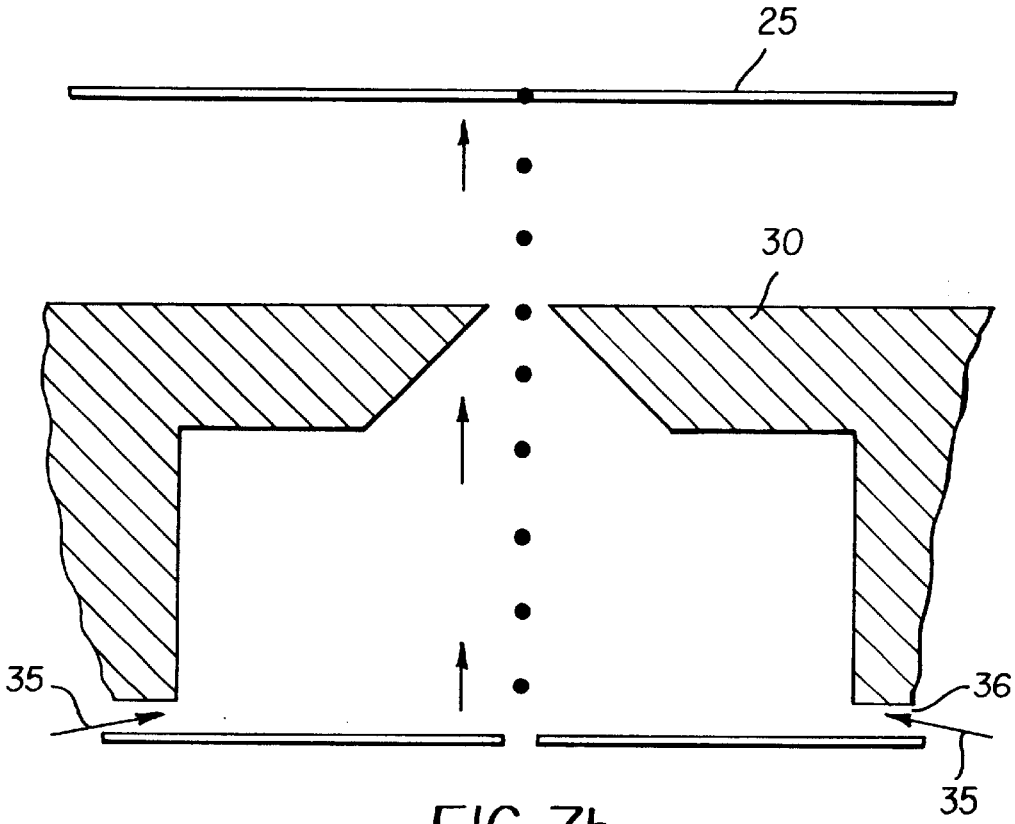
FIG. 7*b* shows drops ejected under the same conditions as FIG. 7*a*, but in the presence of the airflow.

In accordance with the present invention, air flowing through the droplet trajectory guide(s) has not only a velocity component in the direction perpendicular to the drop trajectories but also along the drop trajectories. This feature is usefully employed to increase the drop velocity in the direction it travels compared to the velocity it would otherwise have attained. In particular, drops may be prevented from slowing down excessively, due to drag of the air, so that the receiver may be located further from the printhead. In the extreme case, drops moving too slowly to reach the receiver in the absence of airflow in a droplet trajectory guide can be made to move to the receiver and to be printed in a desired location, regardless of the speed or direction of their initial trajectory. For example in FIG. 7*a*, which shows drops ejected from a nozzle along with the velocity vector representing the speed of the associated drop, drops in the absence of airflow in the air channel are shown to be ejected too slowly to reach the receiver. In this case, where there is no airflow, the velocity of the ejected drops is insufficient to propel them to the receiver. FIG. 7*b* shows the inkjet printhead of FIG. 1*c* in which airflow in the air channel has been restored. In this case, the velocity of the ejected drops is insufficient to propel them to the receiver. The drops reach the receiver and each drop is individually guided to a single desired print location regardless of possible errors in the direction of drop ejection. In FIG. 7*a*, the speed of the drops diminishes at the drop stopping point, as is well know in the art for ejected drops. The drop trajectory-guiding apparatus 30 plays no role in the drop path in this case. However, in FIG. 7*b*, drops ejected under the same conditions but in the presence of the airflow reach the receiver as well as benefit from the trajectory correction as previously described. The drops that reach are individually guided toward a desired trajectory and a desired print location, regardless of possible direction errors in the drop ejection.

Figure 8A:
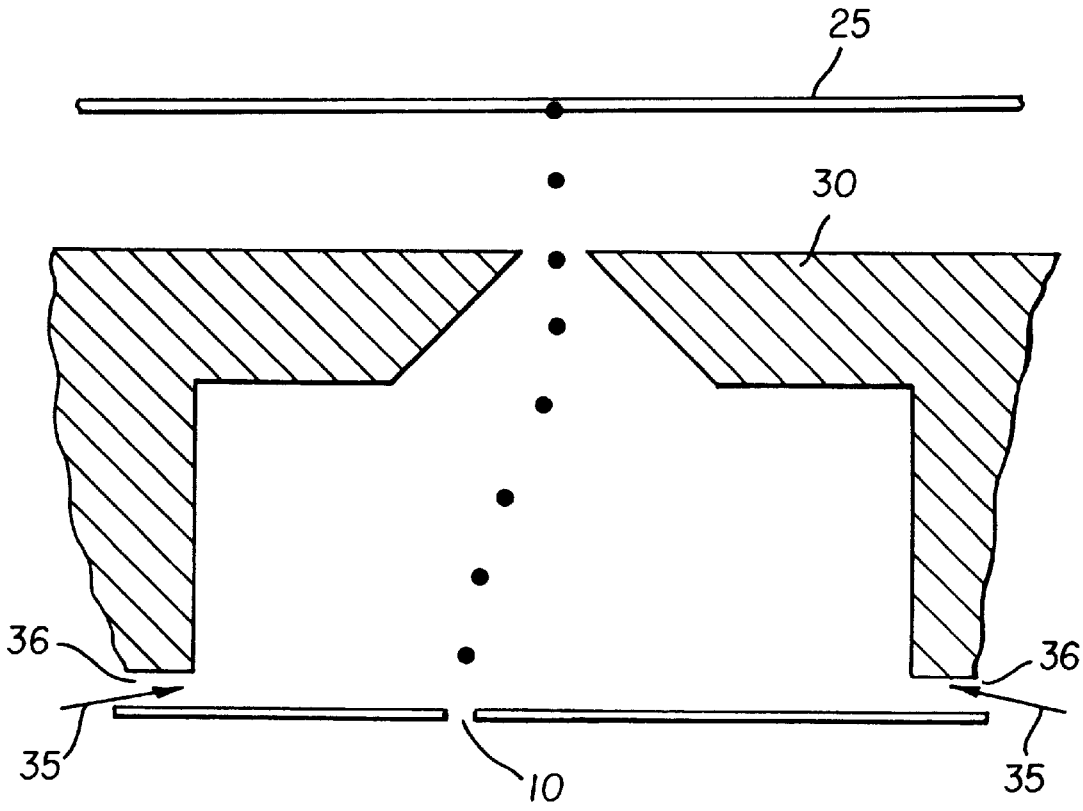
FIG. 8*a* shows a drop trajectory guiding apparatus in cross-section with airflow channels disposed asymmetrically with respect to the nozzles.
Figure 8B:
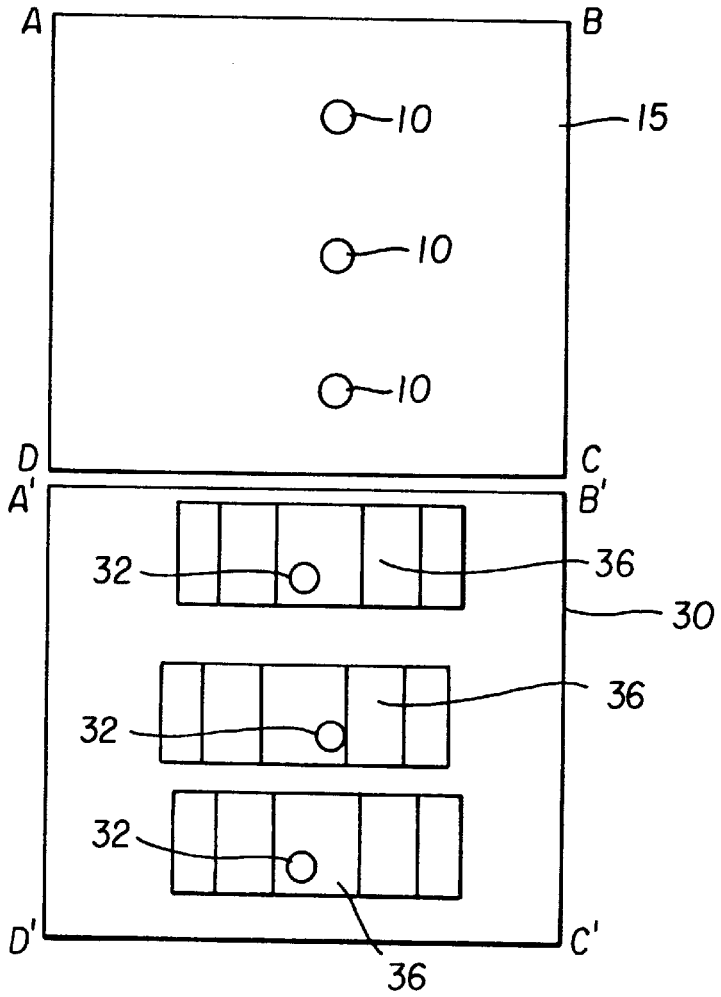
FIG. 8*b* shows a top view of the top surface of a printhead having three nozzles (upper portion of the figure) and a top view of a drop trajectory guiding apparatus (lower portion of the figure) with three exit orifices and three airflow channels. In operation, the drop trajectory guiding apparatus (corners A' to D' resides directly over the printhead top surface (corners A to D)
Figure 8C:
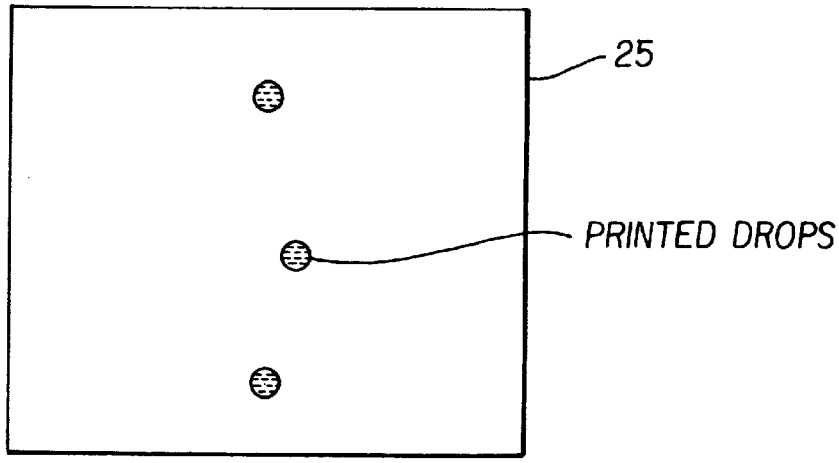
FIG. 8*c* shows the pattern of printed drops at the receiver resulting from the pattern of nozzles shown in FIG. 8*b*.

The pattern of printed drops in accordance with the present invention need not be identical to the pattern of the printhead nozzles. FIG. 8*a* shows a drop trajectory-guiding apparatus 30 in cross-section with airflow channels 36 disposed asymmetrically with respect to the nozzles, i.e. having orifices which are not necessarily directly above each nozzle nor positioned with respect to their associated nozzles each in an identical way. As shown in FIG. 8*a*, the resulting drop trajectory is no longer straight, even for drops initially directed perpendicularly to the printhead top surface. FIG. 8*b* shows a top view of the top surface of a printhead having three nozzles (upper portion of the figure) and a top view of a drop trajectory guiding apparatus (lower portion of the figure) with three exit orifices and three airflow channels asymmetrically disposed in relation to the nozzles., In particular, the exit orifices do not lie in the trajectory which drops would follow in the absence of airflow in the airflow channels. In operation, the drop trajectory guiding apparatus (comers A' to D') resides directly over the printhead top surface (comers A to D), and airflow in the channels guides the drops out the exit orifices. This embodiment is particularly appropriate for small drops ejected at low velocities, whose trajectories are readily controlled by the airflow. The guided drops then land on a receiver and form a pattern of printed drops. As shown in FIG. 8*c*, the pattern of drops is substantially and controllably different from the pattern of nozzles 10 (FIG. 8*b*). In this case the printed pattern (shown in FIG. 8*c*) is no longer a line of equally spaced printed drops, although the nozzles 10 form a line and are equally spaced. This same pattern of printed drops can be seen at the receiver 25 as shown in FIG. 8*c*. As can be appreciated by one skilled in the art of printhead design, the patterns could be such that the printhead nozzles 10 were not spaced equally in a line, where as the printed drops, having been guided by the drop trajectory-guiding apparatus 30, could be equally spaced in a line, as discussed earlier with respect to FIGS. 1*e* and 1*f*.

The invention has been described with reference to a preferred embodiment. However, it will be appreciated that variations and modifications can be effected by a person of ordinary skill in the art without departing from the scope of the invention.

PARTS LIST

5 portion of prior art inkjet printer
10 nozzle
15 printhead top surface
20 ideal drop trajectory
22 errant drop trajectory
22*a* first errant drop trajectory
22*b* second errant drop trajectory
22*c* third errant drop trajectory
24 corrected drop trajectory
25 receiver
30 droplet trajectory-guiding apparatus
31 shelf region
32 exit orifice
33 nozzle wall
33*a* bottom wall
33*b* inner wall
33*c* outer wall
33*d* top wall
34 taper region
35 airflow
36 airflow channel (guide)
40 rotating cylinder
42*a* first rotating trajectory
42*b* second rotating trajectory
42*c* third rotating trajectory
42*d* fourth rotating trajectory
45 airflow shield

What is claimed is:

1. Apparatus for controlling errant ink drops in an inkjet printer having a plurality of nozzles for ejecting ink drops along a droplet trajectory and printing the ejected ink drops onto a receiver, comprising:

a. at least one airflow channel arranged to provide a non-uniform airflow pattern located along a portion of the droplet trajectory, wherein the apparatus is in close proximity to the plurality of nozzles and prior to the receiver, such that the non-uniform airflow pattern provides compensation for errors in the printing of the ejected ink drops on the receiver; and b. air source for moving air in the airflow channel.

2. The apparatus as claimed in claim 1 wherein the airflow channel substantially occupies space between the plurality of nozzles and the receiver.

3. The apparatus as claimed in claim 1 wherein the means for moving air is pressurized air.

4. The apparatus as claimed in claim 1 wherein the means for moving air is a rotating cylinder.

5. The apparatus claimed in claim 1 wherein each of the at least one airflow channels are identical at each nozzle.

6. The apparatus claimed in claim 1 wherein printed ink drops are guided to locations on the receiver in a pattern which is geometrically similar to a nozzle pattern for the inkjet printer.

7. The apparatus claimed in claim 1 wherein the printed ink drops are guided to locations on the receiver in a pattern which is geometrically distinct from a nozzle pattern for the inkjet printer.

8. Apparatus for controlling errant ink drops in an inkjet printer having a plurality of nozzles for ejecting ink drops along a droplet trajectory and printing the ejected ink drops onto a receiver, comprising:

a. a plurality of airflow channels in a one-to-one correspondence with the plurality of nozzles and arranged to provide a non-uniform airflow pattern, located along a portion of the droplet trajectory, wherein the apparatus is in close proximity to the plurality of nozzles and prior to the receiver, such that the non-uniform airflow pattern provides compensation for errors in the printing of the ejected ink drops on the receiver, and b. air source for moving air in the airflow channel.

9. The apparatus as claimed in claim 8 wherein the airflow channels are solid surfaces and pressure is applied to the air guides.

10. The apparatus as claimed in claim 8 wherein the airflow channels include moving surfaces that enable airflow patterns with high airflow velocities.

11. An integrated inkjet print head having a print head top surface that includes at least one nozzle for ejecting ink drops onto a receiver, comprising:

a) a droplet trajectory-guiding apparatus having at least one airflow channel and disposed between the receiver and the print head top surface which is a permanent part of the integrated inkjet print head, b) an air source that causes air flow in and out of the droplet trajectory-guiding apparatus.

12. The inkjet print head claimed in claim 11, wherein the droplet trajectory guiding apparatus includes:

a1) an exit orifice; and a2) a taper region, surrounded by walls, for directing the air flow out through the exit orifice.

13. A method of printing ink drops onto a receiver to desired printing locations, comprising the steps of:

a) providing an airflow guide to guide ejected ink drops;

b) ejecting ink drops from a printer nozzle;

c) directing a non-uniform airstream through the airflow guide to cause errant ink drops to automatically correct before placement on the receiver regardless of any initial misdirection of the ink drops; and d) printing corrected ink drops onto the receiver.

14. The method claimed in claim 13, wherein providing the airflow guide further comprising the step of:

placing the airflow guide between the printer nozzle and the receiver.

15. The method claimed in claim 13, wherein directing the non-uniform airstream further comprising the step of:

providing pressurized air.

16. The method claimed in claim 13, wherein directing the non-uniform airstream further comprising the step of:

providing a rotating cylinder.

17. A method for controlling errant ink drops in an inkjet printer having a plurality of nozzles for ejecting ink drops along a droplet trajectory and printing the ejected ink drops onto a receiver, comprising the steps of:

a. arranging a plurality of airflow to directly cooperate with each of the plurality of nozzles to provide a non-uniform airflow pattern; and b. providing a means for moving air in the plurality of airflow channels such that the non-uniform airflow pattern provides compensation for errors in the printing of the ejected ink drops on the receiver, wherein such means includes forming the non-uniform airflow pattern by using high airflow velocities in the plurality of airflow channels and/or applying pressure to the plurality of airflow channels such that air flows in the plurality of airflow channels.

* * * * *

UNITED STATES PATENT AND TRADEMARK OFFICE

CERTIFICATE OF CORRECTION

PATENT NO. : 6,554,389 B1
DATED : April 29, 2003
INVENTOR(S) : James M. Chwalek et al.

It is certified that error appears in the above-identified patent and that said Letters Patent is hereby corrected as shown below:

Column 14,
Line 1, please add -- channels -- after "airflow"

Signed and Sealed this

Twenty-fourth Day of February, 2004

JON W. DUDAS
*Acting Director of the United States Patent and Trademark Office*